United States Patent [19]

Striebel et al.

[11] Patent Number: 4,512,158

[45] Date of Patent: Apr. 23, 1985

[54] HIGH BLOCKAGE DIFFUSER WITH MEANS FOR MINIMIZING WAKES

[75] Inventors: Edmund E. Striebel, South Windsor; John A. Matthews, Melrose; Domingo Sepulveda, Vernon; Francis C. Pane, Jr., South Windsor, all of Conn.

[73] Assignee: United Technologies Corporation, Hartford, Conn.

[21] Appl. No.: 504,995

[22] Filed: Jun. 16, 1983

[51] Int. Cl.[3] ..... F02C 7/20

[52] U.S. Cl. ..... 60/740; 60/751; 415/DIG. 1

[58] Field of Search ..... 60/740, 751, 39.31, 60/39.32, 39.07; 415/DIG. 1; 138/39

[56] References Cited

U.S. PATENT DOCUMENTS

| | | | |
|---|---|---|---|
| 2,735,612 | 2/1956 | Hausmann | 415/DIG. 1 |
| 2,841,182 | 7/1958 | Scala | 415/DIG. 1 |
| 3,000,401 | 9/1961 | Ringleb | 415/DIG. 1 |
| 3,750,397 | 8/1973 | Cohen et al. | 60/751 X |
| 3,934,410 | 1/1976 | Williams | 60/269 |
| 3,978,664 | 9/1976 | Parker et al. | 60/751 X |
| 4,098,073 | 7/1978 | Adkins et al. | 60/751 X |
| 4,315,715 | 2/1982 | Nishiguchi et al. | 415/DIG. 1 |
| 4,434,957 | 3/1984 | Moritz | 416/223 R |

FOREIGN PATENT DOCUMENTS

| | | | |
|---|---|---|---|
| 1264360 | 3/1968 | Fed. Rep. of Germany | 415/DIG. 1 |
| 694670 | 11/1979 | U.S.S.R. | 415/DIG. 1 |

OTHER PUBLICATIONS

Chang, *Control of Flow Separation*, McGraw-Hill, 1976, pp. 432–445.

*Primary Examiner*—Carlton R. Croyle
*Assistant Examiner*—Jeffrey A. Simenauer
*Attorney, Agent, or Firm*—Norman Friedland

[57] ABSTRACT

This invention minimizes wakes manifested by a fuel nozzle support structure extending through an annular diffuser engine to the burner in a gas turbine engine, spaced walls extending from the inner and outer wall of the diffuser project toward the nozzle support downstream of the support that passes transverse to the flow, one wall being shaped conically and the other being shaped bell-mouthed and convergent.

1 Claim, 3 Drawing Figures

HIGH BLOCKAGE DIFFUSER WITH MEANS FOR MINIMIZING WAKES

CROSS REFERENCE

This invention is related to the invention disclosed in copending patent application entitled CIRCUMFERENTIALLY AREA RULED DUCT, filed by J. A. Matthews, E. E. Striebel, D. Sepulveda and F. C. Pane, Jr., respectively on even date and both assigned to the same assignee of this application.

DESCRIPTION

1. Technical Field

This invention relates to gas turbine engines for powering aircraft and particularly to the prediffuser for feeding compressor discharge air to the burner.

2. Background Art

As is well known, the discharge flow from the axial compressor in a turbine power plant is usually diffused so as to convert the high velocity, high dynamic pressure to a low velocity high static pressure before being admitted to the burner. Ideally, the velocity profile exiting the diffuser and entering the bumper should be circumferentially uniform. In certain engine installations, the fuel nozzle support passes through the diffuser and extends into the burner. Obviously, the support extending into the diffuser flow stream exhibits a flow obstruction with its attendant wakes coming off the support body. These wakes not only degrade the flow streamline but also adversely impact the velocity profile.

We have found that we can reduce the intensity of these wakes that emanate from the fuel injection supports so as to feed a more uniform flow to the burner shrouds. According to this invention, we have incorporated a conical annular inner wall and a bell-mouthed, convergent annular outer wall diffuser integrally designed relative to the fuel injector supports.

It is contemplated that this improvement will allow the combustor section to be designed with a shorter main burner section because the fuel nozzle removal will no longer dictate the required length from the plane where the prediffuser and dump diffuser coincide.

DISCLOSURE OF INVENTION

An object of this invention is to provide an improved diffuser (prediffuser) of the annular type that is subjected to the creation of wakes incident to the fuel injector support structure. A feature of this invention is to incorporate a pair of walls that are in proximity to the fuel injector support that change the flow pattern around the fuel injector body. This invention contemplates that one of the walls is conically shaped and the other is a combined divergent and bell-mouthed convergent shaped.

Other features and advantages will be apparent from the specification and claims and from the accompanying drawings which illustrate an embodiment of the invention.

BEST MODE FOR CARRYING OUT THE INVENTION

Figure 1:
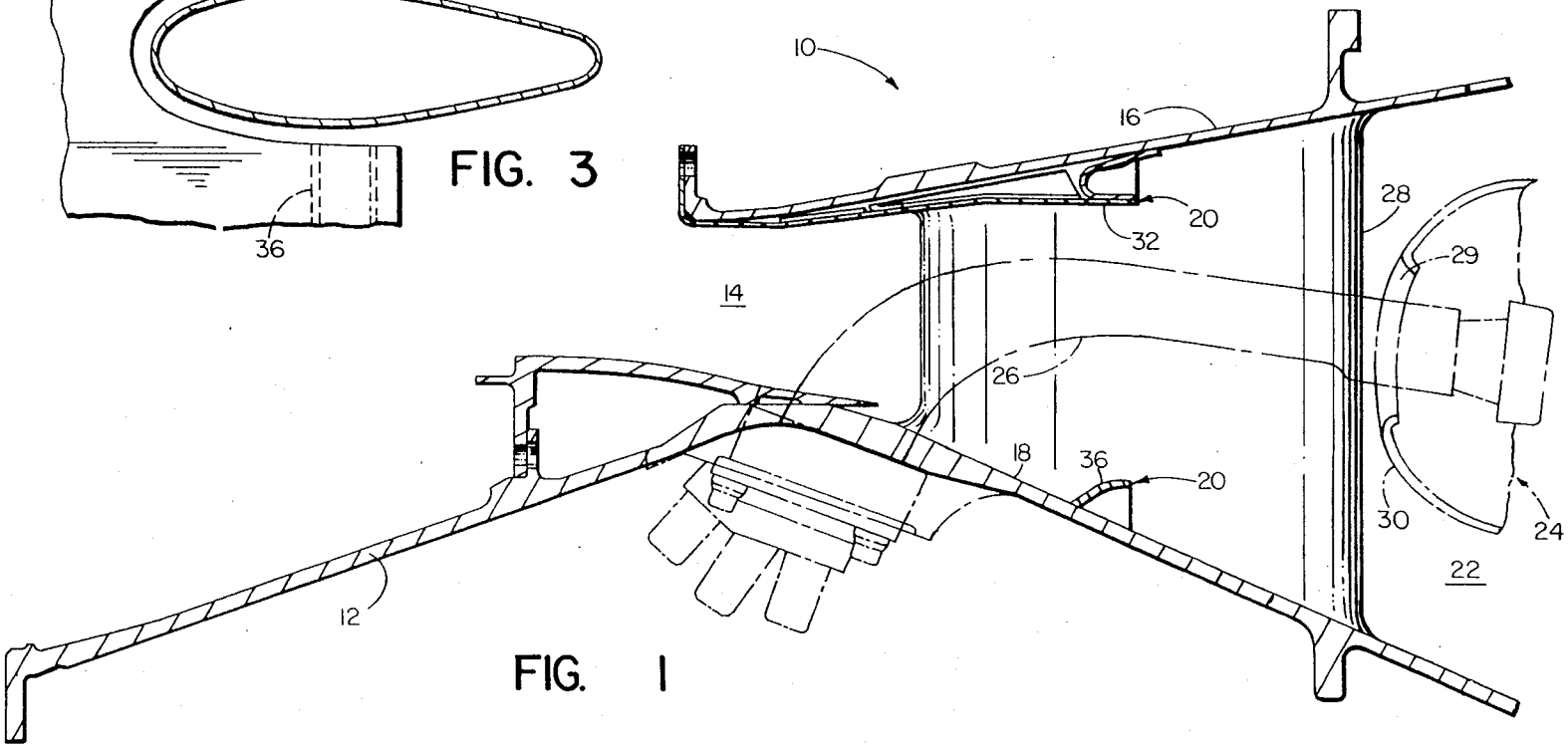
FIG. 1 is a partial view, partly in section and partly in phantom showing the annular diffuser, fuel injector support and annular burner of a gas turbine engine.
Figure 3:
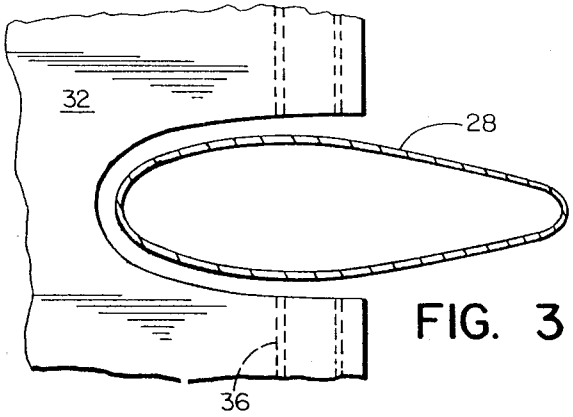
FIG. 3 is a sectional view of the diffuser in FIG. 1 with the fuel injector removed.

While it will be appreciated that this invention in its preferred embodiment is utilized on an existing engine to improve its performance, the invention can be practiced, not only to modify existing engines, but also to be incorporated into new ones. An example of the type of engine where this invention has been utilized is the JT9D engine manufactured by Pratt & Whitney Aircraft division of United Technologies Corporation, which is incorporated herein by reference.

For the sake of simplicity and convenience, as will be appreciated only that portion of the engine is being illustrated herein which is necessary for an understanding of the present invention. As is typical, the diffuser, which in this instance is considered as a prediffuser as will be explained in further detail hereinbelow, is generally indicated by reference numeral 10 and is annular in shape and connected to the high pressure compressor case 12 and the engine case (not shown). Typically, air discharge from the high pressure compressor is fed into inlet 14 of the prediffuser which is formed from an inner conical wall 16 (relative to the center line) and an outer diverging wall 18. The confined air within the prediffuser flows from the inlet 14 to outlet 20 in an increasing cross-sectional area which allows the velocity of the air stream to slow down converting the dynamic pressure head into static pressure, where it discharges into the dump diffuser 22 for diffusing further. The larger portion of air in the dump diffuser is fed into the burner through radial holes (not shown) surrounding the burner liner 24.

Also, typical in this installation is the inclusion of the fuel injector supports 26 which are circumferentially spaced about the annulus and extend through holes formed in the prediffuser outer wall 18 and extend between transverse struts 28 and extend through apertures 29 formed in hood 30. Although not shown in detail the fuel injector support houses the fuel lines and the fuel nozzles feeding fuel into the burner.

Figure 2:
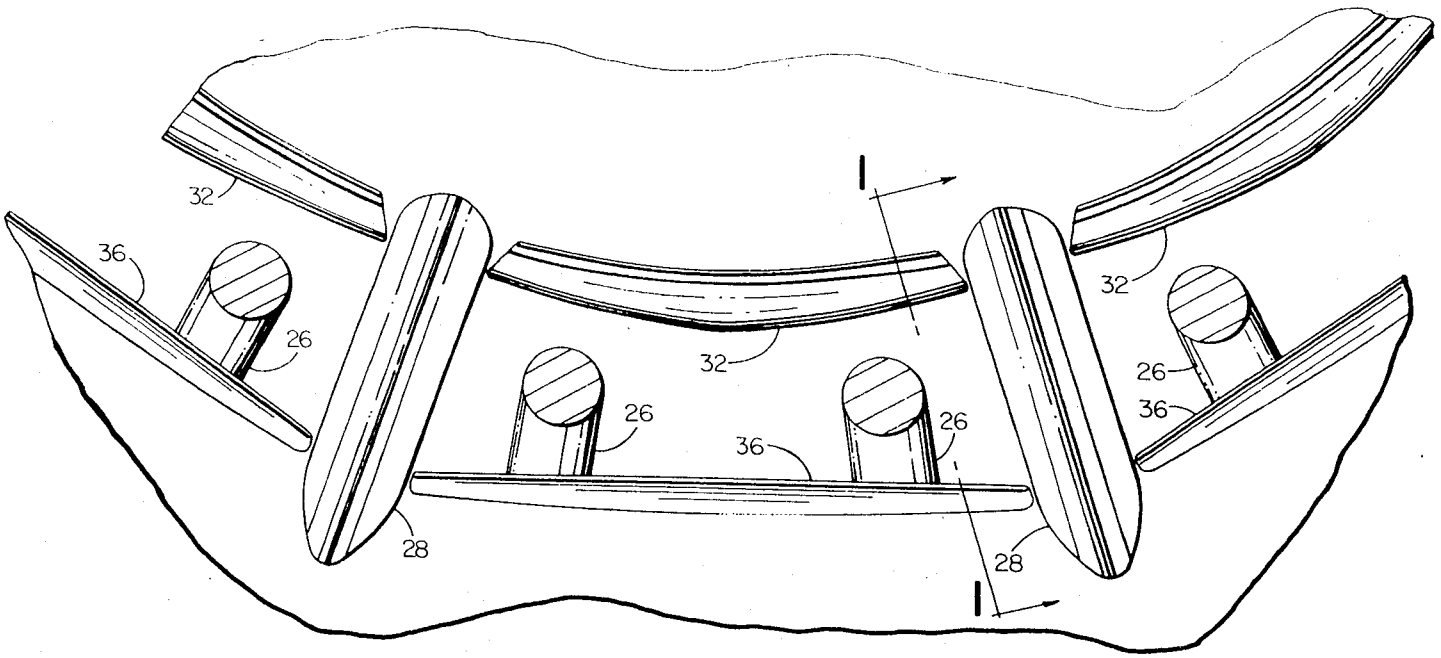
FIG. 2 is a partial end view of the diffuser of FIG. 1.

As is obvious from the foregoing, as the air progresses through the prediffuser, the flow encounters considerable blockage from fuel injector supports 26 which create wakes in the downstream direction which, in turn, propagate into the burner. Their blockage and the blockage from the aerodynamic shaped transverse struts 28 are compensated for by additional divergence of the outer wall 18 beyond that normally provided by an unblocked stable prediffuser. At the aft plane of the transverse portion of the fuel injector supports 26, the flow would normally begin to separate from the outer wall 18 that supports the fuel injector; to this end a bell-mouthed shaped convergent outer wall member 36 acts to converge the flow behind the support and minimize the wake behind the injector support. Both wall members 36 and 32, as can best be seen in FIG. 2, are suitably joined to the diffuser inner and outer wall and extend between struts around the circumference of the diffuser. It will be noted that inner wall member 32 and outer 18 define the prediffuser.

It should be understood that the invention is not limited to the particular embodiments shown and described herein, but that various changes and modifications may be made without departing from the spirit and scope of this novel concept as defined by the following claims.

We claim:

1. For a gas turbine engine having a burner receiving working fluid medium, an annular diffuser having an inner wall and outer wall in axial alignment with the burner but, spaced from said burner directing said working fluid to said burner, a portion of said air discharging from said diffuser entering said burner and a portion of said air admitted to a space surrounding said burner, a fuel nozzle in the front end of said burner in axial alignment with said diffuser, a nozzle support structure extending from a hole in said outer wall of said diffuser extending for a portion transverse to the flow and for the remaining portion axially to support said fuel nozzle, said support structure being an obstruction to the flow passing through said diffuser, means for minimizing wakes in said flow, occasioned by the obstruction of said support structure, including a pair of wall members extending into the passageway of said diffuser spaced from and being on opposite sides of said nozzle support structure for diverging the flow of air adjacent said nozzle support structure and succeedingly converging said flow downstream of said support structure relative to the flow of air in said diffuser, said inner wall and said outer wall being generally conically shaped, one of said pair of wall members being attached to said inner wall and the other of said pair of wall members being attached to the outer wall, one of said pair of wall members and said outer wall defining a prediffusing section and said other pair of wall members being generally bell-mouth shaped so that for portion of its axial length of the prediffuser said prediffuser is in diverging relationship, and in the remaining portion of its axial length the prediffuser is in converging relationship.

* * * * *

UNITED STATES PATENT AND TRADEMARK OFFICE

CERTIFICATE OF CORRECTION

PATENT NO. : 4,512,158

DATED : April 23, 1985

INVENTOR(S) : E. E. Striebel, J. A. Matthews, D. Sepulveda and F. C. Pane, Jr.

It is certified that error appears in the above-identified patent and that said Letters Patent is hereby corrected as shown below:

Column 1, line 24 "bumper" should be --burner--.

Column 2, line 63 after "outer" insert --wall--.

Signed and Sealed this

*Twenty-fifth* Day of *February 1986*

[SEAL]

*Attest:*

DONALD J. QUIGG

*Attesting Officer*

*Commissioner of Patents and Trademarks*